US007308917B2

(12) United States Patent
Krulitsch

(10) Patent No.: US 7,308,917 B2
(45) Date of Patent: Dec. 18, 2007

(54) BEVERAGE BOTTLING PLANT FOR FILLING BOTTLES WITH A LIQUID BEVERAGE MATERIAL HAVING A BOTTLE FILLING MACHINE WITH A FILLING VALVE FOR FILLING BOTTLES WITH A LIQUID BEVERAGE

(75) Inventor: Dieter-Rudolf Krulitsch, Bad Kreuznach (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 369 days.

(21) Appl. No.: 11/082,236

(22) Filed: Mar. 16, 2005

(65) Prior Publication Data

US 2005/0211332 A1 Sep. 29, 2005

(30) Foreign Application Priority Data

Mar. 17, 2004 (DE) ..... 10 2004 013 211

(51) Int. Cl.
*B65B 1/30* (2006.01)

(52) U.S. Cl. ..... 141/198; 141/57; 141/285

(58) Field of Classification Search ..... 141/54, 141/57, 63, 64, 95, 192, 198, 285, 288, 290; 239/432; 222/482, 488
See application file for complete search history.

(56) References Cited

U.S. PATENT DOCUMENTS 3,263,711 A * 8/1966 Laub ..... 141/40
4,279,279 A * 7/1981 Schevey et al. ..... 141/5
4,317,475 A * 3/1982 Miller et al. ..... 141/95
4,513,797 A * 4/1985 Tompkins, Jr. ..... 141/198
5,419,378 A * 5/1995 Law ..... 141/198
5,437,316 A * 8/1995 McPherson ..... 141/86

FOREIGN PATENT DOCUMENTS

| | | |
|---|---|---|
| DE | AS 1122394 | 1/1962 |
| DE | AS 1162711 | 2/1964 |
| DE | AS 1432312 | 2/1970 |
| DE | 2727723 | 1/1979 |
| EP | 0 548 347 A | 6/1993 |
| FR | 1 229 174 A | 9/1960 |

* cited by examiner

*Primary Examiner*—Timothy L. Maust
(74) *Attorney, Agent, or Firm*—Nils H. Ljungman & Associates

(57) ABSTRACT

A beverage bottling plant and method for filling bottles with a liquid beverage material having a bottle filling machine with a filling valve for filling bottles with a liquid beverage. The filling valve having a gas cutoff element comprising a plurality of channels being configured and disposed to permit flow of a liquid into a container disposed at some distance beneath said filling element; each of the plurality of channels having a length, a width, and a height, wherein the width is substantially smaller than at least one of the height and the length, and the height is the distance from said liquid beverage inlet to the liquid beverage outlet.

20 Claims, 4 Drawing Sheets

BEVERAGE BOTTLING PLANT FOR FILLING BOTTLES WITH A LIQUID BEVERAGE MATERIAL HAVING A BOTTLE FILLING MACHINE WITH A FILLING VALVE FOR FILLING BOTTLES WITH A LIQUID BEVERAGE

BACKGROUND

1. Technical Field

The present application relates to a beverage bottling plant for filling bottles with a liquid beverage material having a bottle filling machine with a filling valve for bottling liquids in containers such as bottles, cans and similar vessels.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

The present application relates in particular to the bottling of liquids that contain solid matter, such as beverages that contain fruit pulp and similar substances, such as pulp, cells, fibers or other types of solid matter, for example. These beverages can be bottled using open-jet bottling and without pressing the container against the sealing elements of the filling valve, preferably without counter-pressure.

Filling valves with gas cutoffs or gas locks are used primarily for the bottling of carbonated liquids that are to be transferred from a pressure vessel into a bottle that is connected to the filling mechanism. Before the actual filling begins, the pressure between the bottle and the pressure vessel must be equalized so that the liquid can flow into the bottle on account of the geodetic gradient. During this process, the counterpressure gas in the bottle is displaced into the actual gas headspace as it is replaced by the fluid. For this purpose a return gas tube is used which defines the limit of the actual filling process by means of its bottom end surface, as soon as the level of the fluid reaches said end surface.

An exchange of the gas back into the pressure vessel is thereby no longer possible. On such filling mechanisms, however, there is a danger that the quantity of gas above the surface of the liquid will bubble up through the still open liquid channel, thereby causing an after-running of the liquid that is below the valve seat. To remedy this defect, the prior art has taught that the valve seat can be realized in the form of a siphon and that the valve body can be provided with a cutoff cap which is immersed with its lower edge in the sealing fluid. Apart from the resulting slight reduction in output or capacity or efficiency, this realization of the prior art has the disadvantage that both the groove that forms the siphon channel and the cutoff cap ring must be placed very far down. That is because the cutoff cap is constantly being moved with the valve body of the liquid valve in the closing and opening direction. Because a siphon effect is necessary primarily in the open position, the ring must therefore be at least long enough so that in this position it is immersed to a sufficient depth in the sealing liquid. An additional disadvantage of the configuration of the prior art results from the position of the lower cutoff ring, which differs depending on the open position, which causes constantly changing ratios or conditions of the flow cross sections for the liquid being bottled. That in turn results in different fill levels of the bottles being filled. In addition, special constructive measures that could allow a larger flow cross section taking into consideration the surface tension of the individual liquid being bottled, cannot be introduced as a result of the constantly changing position and the resulting change in the boundary layer of the liquid.

In an additional realization of the prior art, holes are provided at the beginning or on the edge of the cutoff cap to increase the flow cross sections for the liquid being bottled. However, if they are to be perform the desired function, these holes must be raised up from the actual siphon area in the vicinity of the bottling channel, so that it is necessary to provide a siphoning area that can be moved in the axial direction (DE-PS 11 62 711).

DE-AS 1 122 394 also discloses a filling valve for the bottling of liquids in which, in the vicinity of the outlet cross section there is also a disc that has opening slots that run radially. A disc of this type significantly reduces the average open flow cross section. In spite of the radial slots, to the extent that these slots are to perform their intended effect, the flow section cannot be significantly increased.

DE-AS 14 32 312 discloses a construction without a sealing cap which forms the gas cutoff with a backpressure mechanism that incorporates an annular gap and is mounted so that it can move vertically under the action of a spring.

DE-PS 27 27 723 also discloses a construction in which the cap is fastened in a stationary manner to the filling mechanism. The unconventional construction also has disadvantages, however, such as the fact that the cap can no longer be mounted or installed with the valve body, for example.

On filling elements in which the liquid is transported to the bottom of the bottle through a small tube, the rising liquid in the bottle closes the opening of the gas channel for the return gas. It is therefore possible to define the fill level in the bottle by the vertical position of this opening of the gas channel.

When the filling element is realized without a filling tube, in which case the liquid exits the filling element without restriction on the bottle, this type of restriction is not present, because the gas in the neck of the bottle is not prevented from escaping from the bottle. Because of the liquid column that is in the filling element, both the gas that escapes the bottle as well as the surrounding air can rise into the gas headspace of the filler. The bottle would therefore be overfilled, as described above.

To prevent this overfilling, it is possible, for example, to place a narrow-mesh wire screen in the flow path of the liquid, for example, which results in an absolutely secure separation between liquid and gas. The gas—on account of the surface tension that exists between the individual wires—cannot bubble up upward through this wire screen.

The installation of such a narrow-mesh wire screen has the disadvantage that only clear liquids can be bottled, because any fruit particles, fibers, pulp, cells and similar solid matter contained in the beverage will quickly clog the surface of the wire screen and thus interfere with the correct operation of the bottling machine.

OBJECT OR OBJECTS

The object is therefore to create a satisfactory gas cutoff, in particular for the bottling of beverages that contain fruit pulp, cells or other solid matter, while simultaneously guaranteeing the largest possible flow cross section for the liquid to be bottled and its introduction into the respective container with as little dripping and splashing as possible.

SUMMARY

The present application teaches that this object can be accomplished by a filling valve of the type described above, whereby the gas cutoff is realized in the form of a flow element that can be inserted into the liquid channel, and the flow opening of the flow element comprises a plurality of channels that run in the direction of the flow and interact with one another.

Additional characteristics of the embodiments are disclosed in the remaining claims and are described in greater detail below.

The configuration taught by the present application also makes it possible to overcome the disadvantages of the prior art described above. As a result of the special realization of the gas cutoff, even when the filling valve is closed no liquid escapes from it, although the entire space above the bottom end surface of the flow element, i.e. the gas cutoff itself and also the upper space between the closed valve and the upper end surface of the gas cutoff, is filled completely with the liquid being bottled. As a result of the interaction of the channels which are adjacent to one another with their open ends and form a flow cross section that is open to all the channels, a particularly advantageous flow guidance is achieved even with an open-jet bottling process. The jet of liquid being bottled thereby remains laminar and stable, even with a changing volume flow, which prevents splashing and dripping during the open jet bottling process.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The embodiments are explained in greater detail below on the basis of an exemplary embodiment which is illustrated in the accompanying drawing, in which.

DESCRIPTION OF EMBODIMENT OR EMBODIMENTS

Figure 1:
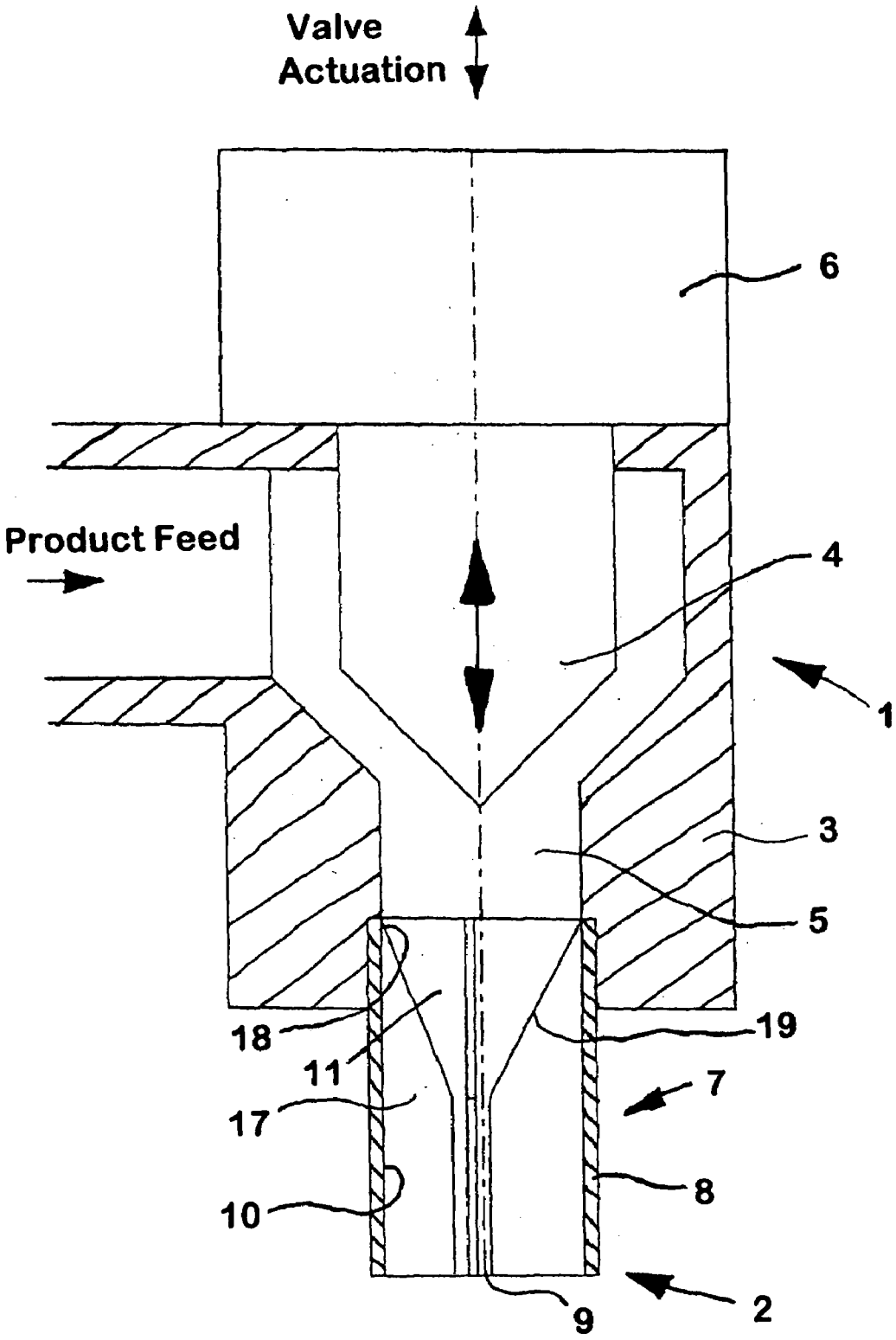
FIG. 1 is a longitudinal section through a filling valve that can be used for the bottling of liquids.
Figure 1A:
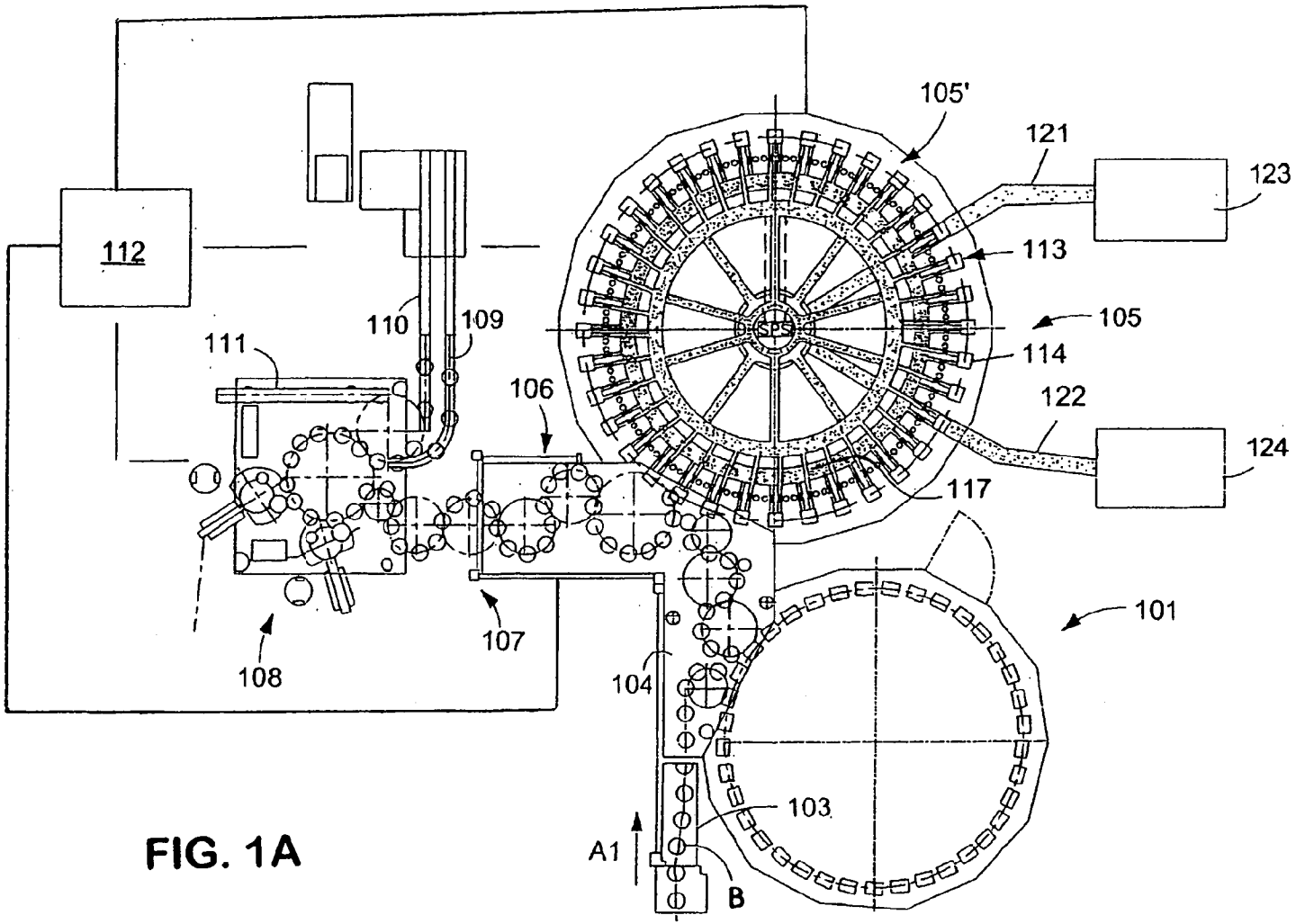
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

FIG. 1 is shown in the form of a simplified drawing of an exemplary embodiment in the form of an open-jet filling valve 1, in which, during the filling process, the containers to be filled remain at some distance from the filler pipe or the actual exit plane 2 of the liquid. The filling valve 1 comprises a valve housing 3 with a liquid channel 5 that can be closed by a valve body 4. An adjustment device 6 for the valve body 4 is located above the valve body 4. In the lower end of the liquid channel 5 there is a gas cutoff 7. This gas lock is mounted on the filler tube so that it can be removed or replaced as necessary. The tube 7 is realized in the form of a flow element 8 connected with the liquid channel 5 and has a plurality of channels 9 that run parallel to the flow direction. These channels preferably begin on the inner cylindrical surface 10 of the flow element 8 and extend from there a sufficient distance into the vicinity of the flow opening 11 until they meet the adjacent additional open channels 12 or transition into the adjacent open channels. In this manner, all the channels 9, 12 form a common opening, the cross section of which expands.

Figure 1B:
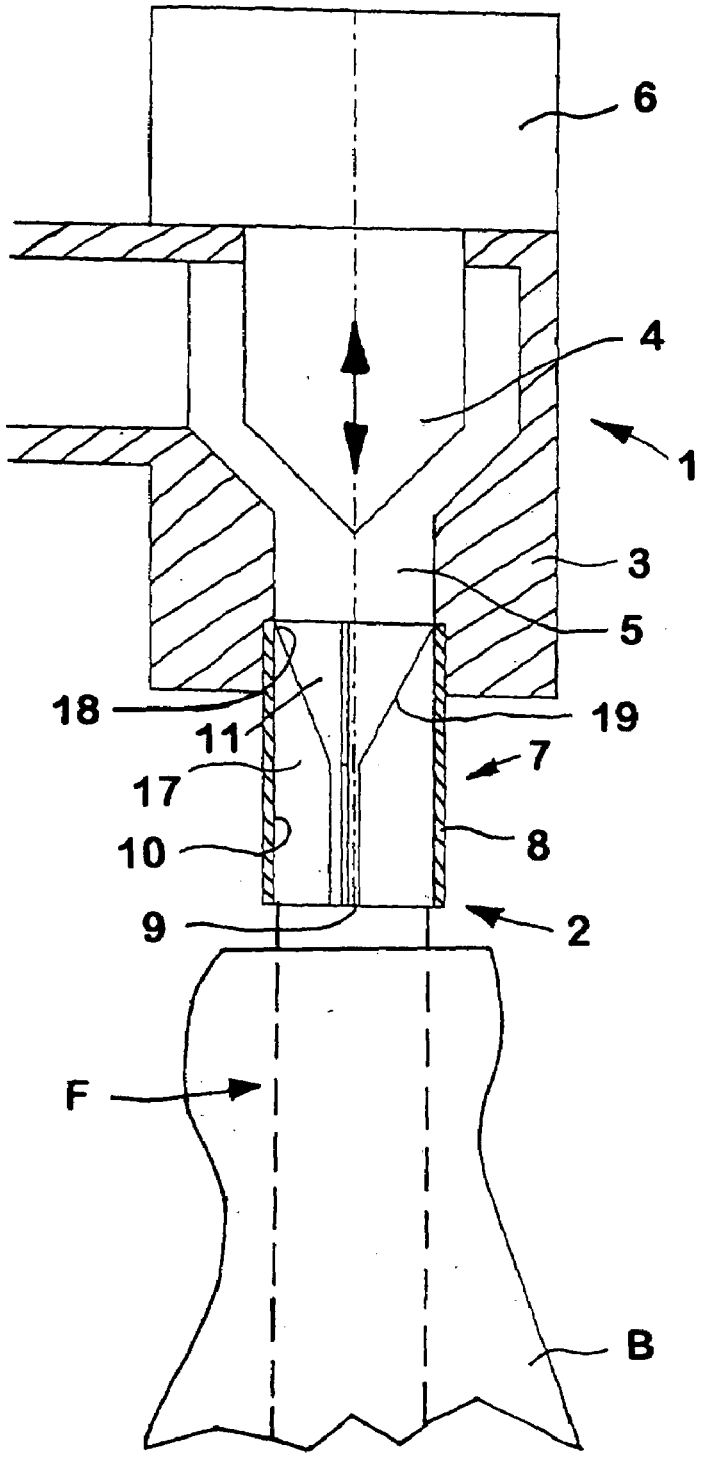
FIG. 1B is similar to FIG. 1 and shows a bottle disposed beneath the filling element.

FIG. 1B is similar to FIG. 1 and shows a bottle B disposed beneath the gas cutoff 7. A flow F of liquid beverage, which liquid beverage may contain fruit pulp, cells, or other solid matter, is shown flowing into the bottle B.

Figure 2:
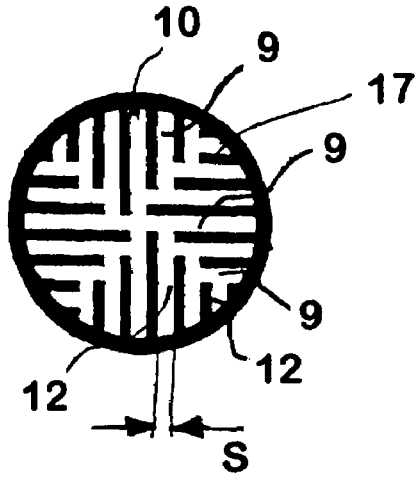
FIG. 2 is a cross section through the gas cutoff itself.

In the gas cutoff 7 illustrated in cross section in FIG. 2, the channels are directed from four sides 13-16 that are oriented at right angles to one another into the vicinity of the flow opening 11, and in this manner form an opening that is without obstacles toward all the channels 9, 12. With a geometric opening selected in this way, the channels 9, 12 meet one another at right angles. However, other geometric arrangements are also conceivable, e.g. proceeding from three sides, so that the channels 9, 12 transition into one another at an angle other than a right angle.

Figure 3:
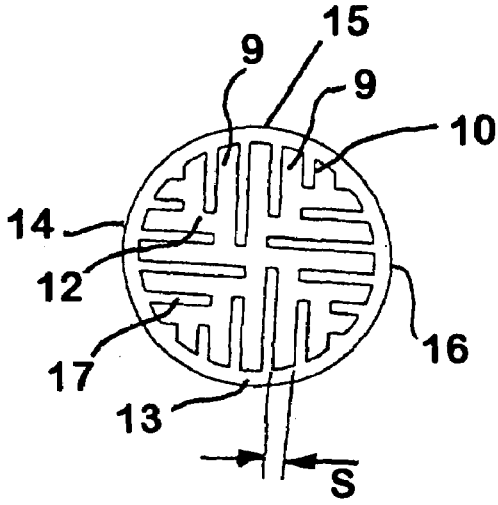
FIG. 3 is a gas cutoff with enlarged channels, also shown in cross section.

The channels are advantageously formed by fins 17 that project from the inner cylindrical surface of the flow opening 11 and are located at some distance from one another. These fins, as shown in FIG. 1, run downward from the upper starting point 18 at an angle (angle 19) toward the center, as a result of which, among other things, on account of the funnel effect that is created, there is a particularly advantageous self-cleaning of the interior and of the channels during the bottling of beverages that contain fruit pulp or solid matter. In the illustrated exemplary embodiment, the slanted length of the fins 17 equals approximately one-half the total length of the fins. Depending on the product being bottled and the task at hand, other length ratios can also be used. Instead of a slanted section, round, parabolic or other advantageous shapes and configurations or combinations thereof can be provided. The channel widths S are preferably equal to one another, so that a particularly calm and non-turbulent flow of the liquid being bottled is guaranteed. As shown in FIG. 3, other channel and/or fin widths can be used for different liquids.

It is of particular importance for the configuration of the fins 17 that the fins 17 and with them also the slanted portions 19 that are located on their upper ends end in the open space and thereby maintain a distance from other fins 17 that is approximately equal to the channel width S. Because the fins 17 end in the open space, a reliable removal of the solids that are contained in the liquid being bottled is guaranteed, as a result of which the self-cleaning effect is positively assisted and a potential clogging of the gas cutoff can be reliably prevented.

The design of the fins 17 and the space S between the fins 17 is such that it permits pulp or large solid particles to flow freely through the nozzle and into a bottle to be filled, which bottle is separated from the nozzle by some distance, while still functioning as a gas blocker or stopper. In addition, the flow of a liquid through the nozzle is kept laminar and stable, even with a changing volume flow, which prevents splashing and dripping during the open jet bottling process.

FIG. 3 shows another possible embodiment with a larger space S between the fins 17. In this possible embodiment, the spaces S may be larger in order to accommodate a liquid beverage with a higher surface tension. Calculations regarding surface tension are well known. However, because different liquid beverages may contain pulp or solid matter of different sizes or quantity, experimentation regarding the exact spacing between the fins 17 may be required for different liquids. FIG. 3 is only one other possible embodiment of the flow element. Since different types of liquid beverages may have different surface tensions because of differing composition and/or viscosity, the spaces S between the fins 17 may be larger or smaller in other possible embodiments. Again, routine experimentation may be required to determine the desired spacing of the spaces S for different beverages or other liquids having different surface tension characteristics.

The present application relates to a filling valve for the bottling of liquids in containers such as bottles, cans and similar vessels with a closable liquid channel and a gas cutoff associated with it, whereby the gas cutoff is realized in the form of a flow element that interacts with the liquid channel, and the flow opening of the flow element comprises a plurality of channels that interact with one another and run in the flow direction.

An example of a bottle filling machine, components of which may possibly be utilized or adapted for use in at least one possible embodiment, may be found in U.S. patent application entitled "A beverage bottling plant for filling bottles with a liquid beverage material having a filling element and a filling machine having such filling elements," filed on Mar. 4, 2005, having Ser. No. 11/072,634 and German Patent Application No. 10 2004 011 101, filed on Mar. 6, 2004, entitled "Füllelement sowie Füllmaschine mit derartigen Füllelementen," and the English translation thereof. Each of the above applications are incorporated by reference as if set forth in their entirety herein.

One feature or aspect of an embodiment is believed at the time of the filing of this patent application to possibly reside broadly in a filling valve for the bottling of liquids in containers such as bottles, cans and similar vessels with a closable liquid channel and a gas cutoff that corresponds to said liquid channel, characterized by the fact that the gas cutoff is realized in the form of a flow element that interacts with the liquid channel, the flow opening of which comprises a plurality of channels that interact with one another and run in the direction of the flow.

Another feature or aspect of an embodiment is believed at the time of the filing of this patent application to possibly reside broadly in a filling valve, characterized by the fact that the channels are oriented with their open end from the inside wall of the flow opening into its interior.

Yet another feature or aspect of an embodiment is believed at the time of the filing of this patent application to possibly reside broadly in a filling valve, characterized by the fact that the channels are oriented with their open ends toward the center and/or the axes of symmetry of the flow opening.

Still another feature or aspect of an embodiment is believed at the time of the filing of this patent application to possibly reside broadly in a filling valve, characterized by the fact that the channels are adjacent to one another with their open ends and form a flow cross section that is open to all the channels.

A further feature or aspect of an embodiment is believed at the time of the filing of this patent application to possibly reside broadly in a filling valve, characterized by the fact that the channels are oriented from four sides or directions at right angles to one another into the space of the flow opening.

Another feature or aspect of an embodiment is believed at the time of the filing of this patent application to possibly reside broadly in a filling valve, characterized by the fact that the channels meet one another with their open ends at a right angle.

Yet another feature or aspect of an embodiment is believed at the time of the filing of this patent application to possibly reside broadly in a filling valve, characterized by the fact that the channels meet one another with their open ends at an angle other than a right angle.

Still another feature or aspect of an embodiment is believed at the time of the filing of this patent application to possibly reside broadly in a filling valve, characterized by the fact that the channels are formed by fins that project from the inner cylindrical surface of the flow opening and are at some distance from one another.

A further feature or aspect of an embodiment is believed at the time of the filing of this patent application to possibly reside broadly in a filling valve, characterized by the fact that the fins that enclose the channels between them have at least in some areas a slanted portion that runs from their upper edge toward the center.

Another feature or aspect of an embodiment is believed at the time of the filing of this patent application to possibly reside broadly in a filling valve, characterized by the fact that the individual fins have at least partly slanted surfaces, beginning from the inner cylindrical surface of the flow opening.

Yet another feature or aspect of an embodiment is believed at the time of the filing of this patent application to possibly reside broadly in a filling valve, characterized by the fact that the length of the slanted section of the fins equals approximately one-half of the total length of the fin.

Still another feature or aspect of an embodiment is believed at the time of the filing of this patent application to possibly reside broadly in a filling valve, characterized by the fact that the lengths of the slanted sections of the individual fins are identical.

A further feature or aspect of an embodiment is believed at the time of the filing of this patent application to possibly reside broadly in a filling valve, characterized by the fact that the lengths of the slanted sections of the individual fins are different.

Another feature or aspect of an embodiment is believed at the time of the filing of this patent application to possibly reside broadly in a filling valve, characterized by the fact that the slanted section is realized in the form of a rounded portion.

Yet another feature or aspect of an embodiment is believed at the time of the filing of this patent application to possibly reside broadly in a filling valve, characterized by the fact that the slanted portion is realized in the form of a parabola.

Still another feature or aspect of an embodiment is believed at the time of the filing of this patent application to possibly reside broadly in a filling valve, characterized by the fact that the slanted portion is realized in the form of a curve.

A further feature or aspect of an embodiment is believed at the time of the filing of this patent application to possibly reside broadly in a filling valve, characterized by the fact that the slanted portions of the individual fins when considered together form a funnel-shaped structure.

Another feature or aspect of an embodiment is believed at the time of the filing of this patent application to possibly reside broadly in a filling valve, characterized by the fact that the width of the channels is constant.

Yet another feature or aspect of an embodiment is believed at the time of the filing of this patent application to possibly reside broadly in a filling valve, characterized by the fact that the fins end in the open space.

The components disclosed in the various publications, disclosed or incorporated by reference herein, may possibly be used in possible embodiments of the present invention, as well as equivalents thereof.

Some examples of bottling systems, which may be used or adapted for use in at least one possible embodiment of the present may be found in the following U.S. patents assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat.

No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of filling machines that utilize electronic control devices to control various portions of a filling or bottling process and that may possibly be utilized or possibly adapted for use in at least one possible embodiment of the present application may possibly be found in the following U.S. patents: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

The appended drawings in their entirety, including all dimensions, proportions and/or shapes in at least one embodiment of the invention, are accurate and are hereby included by reference into this specification.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and No. 6,025,684 issued to Yasui on Feb. 15, 2000.

All, or substantially all, of the components and methods of the various embodiments may be used with at least one embodiment or all of the embodiments, if more than one embodiment is described herein.

Some examples of synchronous motors which may possibly be utilized or adapted for use in at least one possible embodiment may possibly be found in the following U.S. patents: U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of computer systems that may possibly be utilized or possibly adapted for use in at least one possible embodiment of the present application may possibly be found in the following U.S. patents: U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

All of the patents, patent applications and publications recited herein, and in the Declaration attached hereto, are hereby incorporated by reference as if set forth in their entirety herein.

Some examples of control valve apparatus that may possibly be utilized or possibly adapted for use in at least one possible embodiment of the present application may possibly be found in the following U.S. patents: U.S. Pat. No. 5,406,975 issued to Nakamichi et al. on Apr. 18, 1995; U.S. Pat. No. 5,503,184 issued to Reinartz et al. on Apr. 2, 1996; U.S. Pat. No. 5,706,849 issued to Uchida et al. on Jan. 13, 1998; U.S. Pat. No. 5,975,115 issued to Schwegler et al. on Nov. 2, 1999; U.S. Pat. No. 6,142,445 issued to Kawaguchi et al. on Nov. 7, 2000; and U.S. Pat. No. 6,145,538 issued to Park on Nov. 14, 2000.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of nozzle structures that may possibly be utilized or possibly adapted for use in at least one possible embodiment of the present application may possibly be found in the following U.S. patents: U.S. Pat. No. 6,042,026 issued to Buehler, II on Mar. 28, 2000; U.S. Pat. No. 6,394,366 issued to Adams on May 28, 2002; U.S. Pat. No. 6,402,062 issued to Bendig et al. on Jun. 11, 2002; U.S. Pat. No. 6,616,072 issued to Harata et al. on Sep. 9, 2003; U.S. Pat. No. 6,666,386 issued to Huang on Dec. 23, 2003; and U.S. Pat. No. 6,681,498 issued to Steffan on Jan. 27, 2004.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of starwheels which may possibly be utilized or adapted for use in at least one possible embodiment may possibly be found in the following U.S. patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The corresponding foreign and international patent publication applications, namely, Federal Republic of Germany Patent Application No. 10 2004 013 211.9, filed on Mar. 17, 2004, having inventor Dieter Rudolf Krulitsch, and DE-OS 10 2004 013 211.9 and DE-PS 10 2004 013 211.9, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A beverage bottling plant for filling beverage bottles with liquid beverage material, said beverage bottling plant comprising:

a beverage bottle cleaning machine being configured and disposed to clean beverage bottles;

a feed arrangement to supply beverage bottles to said beverage bottle cleaning machine;

a beverage filling machine being configured and disposed to fill beverage bottles with liquid beverage material;

said beverage filling machine comprising a plurality of beverage filling devices for filling beverage bottles with liquid beverage material;

at least one storage unit being configured and disposed to store a supply of liquid beverage material;

at least one supply line being configured and disposed to connect said at least one storage unit to said beverage filling machine to supply liquid beverage material to said beverage filling machine;

a first conveyer arrangement being configured and disposed to move beverage bottles from said beverage bottle cleaning machine into said beverage filling machine;

said first conveyer arrangement comprising a star wheel structure;

a beverage bottle closing machine being configured and disposed to close tops of filled beverage bottles;

a second conveyer arrangement being configured and disposed to move filled beverage bottles from said beverage filling machine into said beverage bottle closing machine;

said second conveyer arrangement comprising a star wheel structure;

a beverage bottle labeling machine being configured and disposed to label filled, closed beverage bottles;

a third conveyor arrangement being configured and disposed to move filled, closed beverage bottles from said beverage bottle closing machine into said beverage bottle labeling machine;

said third conveyer arrangement comprising a star wheel structure;

a beverage bottle packing station being configured and disposed to package labeled, filled, closed beverage bottles;

a fourth conveyor arrangement being configured and disposed to move labeled, filled, closed beverage bottles from said beverage bottle labeling machine to said beverage bottle packing station;

said fourth conveyer arrangement comprising a linear conveyor structure being configured and disposed to arrange beverage bottles in groups for packing;

said beverage filling machine comprising a plurality of filling elements disposed on the periphery of the rotor;

each of said filling elements comprising:

a filling valve being configured and disposed to fill bottles with a liquid beverage containing pulp or solid matter;

a closable liquid channel being configured and disposed to regulate the flow of a liquid beverage containing pulp or solid matter into a bottle;

a gas cutoff element being configured and disposed to further regulate the flow of a liquid beverage containing pulp or solid matter into a bottle;

said gas cutoff element having a first end comprising a liquid beverage inlet and a second end comprising a liquid beverage outlet;

said gas cutoff element being disposed beneath and connected to said closable liquid channel at said first end of said gas cutoff element;

said gas cutoff element comprising a plurality of slots being configured and disposed to permit flow of a liquid beverage containing pulp or solid matter into a bottle disposed at some distance beneath said filling element;

each of said plurality of slots having a length, a width, and a height, wherein said width is substantially smaller than both said height and said length, and said height is the distance from said liquid beverage inlet to said liquid beverage outlet;

said plurality of slots being configured and disposed to substantially prevent the flow of gas into said gas cutoff element and to promote a well-behaved flow of a liquid beverage and to minimize splashing of a liquid beverage upon filling of a bottle with liquid beverage; and said plurality of slots being configured and disposed to retain, at least by surface tension, an amount of liquid beverage inside said gas cutoff element to substantially prevent the flow of gas into said gas cutoff element and to minimize dripping of liquid beverage out of said gas cutoff element upon completion of filling of a bottle with liquid beverage.

2. A method of filling containers, such as bottles, cans, and similar vessels, with a liquid filling valve arrangement, said filling valve arrangement comprising: a closable liquid channel being configured and disposed to regulate the flow of a liquid into a container; a gas cutoff element being configured and disposed to further regulate the flow of a liquid into a container and to minimize the flow of gas into said gas cutoff element upon filling of a container and upon completion of filling of a container; said gas cutoff element having a first end comprising a liquid inlet and a second end comprising a liquid outlet; said gas cutoff element being disposed beneath and connected to said closable liquid channel at said first end of said gas cutoff element; said gas cutoff element comprising a plurality of channels being configured and disposed to permit flow of a liquid into a container disposed at some distance beneath said filling element; each of said plurality of channels having a length, a width, and a height, wherein said width is substantially smaller than at least one of said height and said length, and said height is the distance from said liquid beverage inlet to said liquid beverage outlet, said method comprising the steps of:

opening said closable liquid channel to permit flow of liquid into said gas cutoff element;

flowing liquid through said gas cutoff element and into a container disposed a distance from said liquid outlet and minimizing flow of gas into said gas cutoff element;

closing said closable liquid channel to stop flow of liquid into said gas cutoff element upon the container being filled to a desired level; and retaining liquid in said gas cutoff element to minimize flow of gas into said gas cutoff element upon closing of said closable liquid channel.

3. A filling valve arrangement for the filling of liquids into containers, such as bottles, cans, and similar vessels, said filling valve arrangement comprising:

a closable liquid channel being configured and disposed to regulate the flow of a liquid into a container;

a gas cutoff element being configured and disposed to further regulate the flow of a liquid into a container and to minimize the flow of gas into said gas cutoff element upon filling of a container and upon completion of filling of a container;

said gas cutoff element having a first end comprising a liquid inlet and a second end comprising a liquid outlet;

said gas cutoff element being disposed beneath and connected to said closable liquid channel at said first end of said gas cutoff element;

said gas cutoff element comprising a plurality of channels being configured and disposed to permit flow of a liquid into a container disposed at some distance beneath said filling element;

each of said plurality of channels having a length, a width, and a height, wherein said width is substantially smaller than at least one of said height and said length, and said height is the distance from said liquid beverage inlet to said liquid beverage outlet.

4. The filling valve arrangement according to claim 3, wherein:

said plurality of channels being configured and disposed to substantially prevent the flow of gas into said gas cutoff element and to promote a well-behaved flow of a liquid beverage and to minimize splashing of a liquid beverage upon filling of a bottle with liquid beverage; and said plurality of channels being configured and disposed to retain, at least by surface tension, an amount of liquid beverage inside said gas cutoff element to substantially prevent the flow of gas into said gas cutoff element and to minimize dripping of liquid beverage out of said gas cutoff element upon completion of filling of a bottle with liquid beverage.

5. The filling valve arrangement as claimed in claim 4, characterized by the fact that the channels (9, 12) are oriented with their open end from the inside wall (10) of the flow opening (11) into its interior.

6. The filling valve arrangement as claimed in claim 5, characterized by the fact that the channels (9, 12) are oriented with their open ends toward the center and/or the axes of symmetry of the flow opening (11).

7. The filling valve arrangement as claimed in claim 6, characterized by the fact that the channels (9, 12) are adjacent to one another with their open ends and form a flow cross section that is open to all the channels.

8. The filling valve arrangement as claimed in claim 7, characterized by the fact that the channels (9, 12) are oriented from four sides or directions (13-16) at right angles to one another into the space of the flow opening.

9. The filling valve arrangement as claimed in claim 8, characterized by the fact that the channels (9, 12) meet one another with their open ends at a right angle.

10. The filling valve arrangement as claimed in claim 9, characterized by the fact that the channels (9, 12) meet one another with their open ends at an angle other than a right angle.

11. The filling valve arrangement as claimed in claim 10, characterized by the fact that the channels (9, 12) are formed by fins (17) that project from the inner cylindrical surface of the flow opening and are at some distance from one another.

12. The filling valve arrangement as claimed in claim 11, characterized by the fact that the fins (17) that enclose the channels (9, 12) between them have at least in some areas a slanted portion (19) that runs from their upper edge (18) toward the center.

13. The filling valve arrangement as claimed in claim 12, characterized by the fact that the individual fins (17) have at least partly slanted surfaces, beginning from the inner cylindrical surface (10) of the flow opening (11).

14. The filling valve arrangement as claimed in claim 13, characterized by the fact that the length of the slanted section of the fins (17) equals approximately one-half of the total length of the fin.

15. The filling valve arrangement as claimed in claim 14, characterized by the fact that the lengths of the slanted sections (19) of the individual fins (17) are identical.

16. The filling valve arrangement as claimed in claim 15, characterized by the fact that the lengths of the slanted sections (19) of the individual fins (17) are different.

17. The filling valve arrangement as claimed in claim 16, characterized by the fact that the slanted section (19) is realized in the form of a rounded portion.

18. The filling valve arrangement as claimed in claim 17, characterized by the fact that the slanted portion (19) is realized in the form of a parabola.

19. The filling valve arrangement as claimed in claim 18, characterized by the fact that the slanted portion (19) is realized in the form of a curve.

20. The filling valve arrangement as claimed in claim 19, characterized by the fact that the slanted portions (19) of the individual fins (17) when considered together form a funnel-shaped structure, and the width of the channels (9, 12) is constant, and the fins end in the open space.

* * * * *